US006062669A

United States Patent [19]

Lee

[11] Patent Number: 6,062,669

[45] Date of Patent: May 16, 2000

[54] METHOD FOR DETECTING INK CARTRIDGE STATUS

[75] Inventor: Jae-Han Lee, Yongin, Rep. of Korea

[73] Assignee: SamSung Electronics Co., Ltd., Kyungki-do, Rep. of Korea

[21] Appl. No.: 08/934,515

[22] Filed: Sep. 22, 1997

[30] Foreign Application Priority Data

Sep. 21, 1996 [KR] Rep. of Korea ..... 96-41484

[51] Int. Cl.[7] ..... B41J 29/393

[52] U.S. Cl. ..... 347/19; 347/19

[58] Field of Search ..... 347/19, 7; 399/24, 399/25, 27

[56] References Cited

U.S. PATENT DOCUMENTS 4,872,027 10/1989 Buskirk et al. ..... 347/19
5,049,898 9/1991 Arthur et al. ..... 347/19
5,068,806 11/1991 Gatten ..... 395/113
5,138,344 8/1992 Ujita ..... 347/86
5,365,312 11/1994 Hillmann et al. ..... 399/12
5,406,315 4/1995 Allen et al. ..... 347/7
5,414,452 5/1995 Accatino et al. ..... 347/7
5,439,302 8/1995 Andou et al. ..... 400/124.07
5,610,635 3/1997 Murray et al. ..... 347/7
5,631,674 5/1997 Shinada et al. ..... 347/7
5,636,032 6/1997 Springett ..... 358/32
5,663,750 9/1997 Sakuma ..... 347/7

*Primary Examiner*—John Barlow
*Assistant Examiner*—Charles W. Stewart, Jr.
*Attorney, Agent, or Firm*—Robert E. Bushnell, Esq.

[57] ABSTRACT

A method for detecting ink cartridge status, corresponding to ink cartridge IDs including the steps of displaying the state information of the cartridge, identified by a cartridge ID entered by a user on the monitor, and summing the ink consumption of the cartridge during printing.

14 Claims, 2 Drawing Sheets

METHOD FOR DETECTING INK CARTRIDGE STATUS

CLAIM OF PRIORITY

This application makes reference to, incorporates the same herein, and claims all rights accruing thereto under 35 U.S.C. § 121 through my patent application entitled Method For Detecting The State Of An Ink Cartridge Of An Ink Jet Printer earlier filed in the Korean Industrial Property Office on the 21th day of September 1996 and there duly assigned Serial No. 41484/1996.

BACKGROUND OF THE INVENTION

1. Field of the Invention

The present invention relates to an ink jet printer, and more particularly a method for detecting the status of an ink jet printer cartridge.

2. Description of the Related Art

Generally, when a printer ink cartridge runs out of ink, the user must buy a spare ink cartridge to replace the spent cartridge in order to continue printing. Often, once the old cartridge is replaced, the printer incorrectly identifies the new ink cartridge as the previous one. The misinformed printer utilizes the new cartridge as it would the old already replaced cartridge, and therefore fails to use the new ink cartridge to the end of its lifetime. To avoid this, after replacing an ink cartridge, the printer must be reset to recognize the new ink cartridge.

Exemplars of the practice in the art include four groupings of designs for ink jet printer. A first grouping of these designs use analog sensors. For Example U.S. Pat. No. 5,406,315 for Method and System for Remote-sensing Ink Temperature and Melt-on-Demand Control for a Hot Melt Ink Jet Printer issued to Allent et al., includes thermal sensors which register when a sufficient amount of ink is sufficiently heated to melt ink so that it may be disposed on a recording paper. U.S. Pat. No. 5,631,674 for Recording Apparatus issued to Shinada et al. describes a sensor which includes optical detection of the ink remaining within a reservoir. An alternative embodiment includes a sensor which registers the changing conductivity of the ink to ascertain when an insufficient amount of ink remains in the reservoir.

A second grouping of designs includes cartridges or adaptors provided with memory elements. For example, U.S. Pat. No. 5,610,635 for Printer Ink Cartridge with Memory Storage Capacity issued to Murray et al., describes a cartridge having a EEPROM and logic element which counts when the driver circuit is energized to heat the element that ejects ink and/or paper. The information on the cartridge is accessible, however not displayed. U.S. Pat. No. 5,138,344 for Ink Jet Apparatus and Ink Jet Cartridge Therefor issued to Ujita, describes an adaptor having memory thereon. As with the '635 patent, the host computer may access information on the adaptor, however such as not displayed.

U.S. Pat. No. 5,365,312 for Arrangement for Printer Equipment for Monitoring Reservoirs That Contain Printing Medium issued to Hillmann et al., describes a reservoir that printer been integrated with a memory circuit which uses a debit card logic. As ink is used, the counter is decremented to a value corresponding till when ink no longer remains in the reservoir. The memories are not reprogrammable even when the reservoir is refilled. U.S. Pat. No. 5,049,898 for Printhead Having Memory Element issued to Arthur et al., describes a cartridge with a memory including identification information. A logic circuit counts the number of ink drops which are ejected from the cartridge installed that in the memory. The cartridge also includes a low-ink dialed alarm.

The third grouping which include programs that count drops or relate graphic data to prescribed ink use therefor. For example, U.S. Pat. No. 5,068,806 for Method of Determining Useful Life of Cartridge for an Ink Jet Printer issued to Gatten, describes a program which counts the number of dots fired from a cartridge. The reference cautions that the same cartridge must be used to avoid generation of faulty data. U.S. Pat. No. 5,663,750 for Ink Ejection Device With Ink Saving Mode Used When Remaining Ink Amount Ink Amount Is Small issued to Sakuma describes a program which evaluates the bit pattern data of matter to be printed and determines the number of ink dots required to form an image on a recording paper. Although a cartridge detector is used, specific cartridge identity recognition logic is not. Further the design does not provide for displaying the cartridge status, only warning when not enough ink remains. Moreover, this design does not relate to the specific identity of cartridge is used. U.S. Pat. No. 5,414,452 for Recognition of Ink Expire in an Ink Jet Printing Head issued to Accatino et al. includes a somewhat similar program as with the '750 reference, only the operator must reset the counter when a new cartridge is inserted. U.S. Pat. No. 5,439,302 for Self-adjusting Controller for Dot Impact Printer issued to Andou et al. describes a program which counts the pulses that are sent to mechanisms which cause dot wires to fall on a platen. Such information is used to adjust the strike mechanics of the dot wires.

The fourth grouping uses devices that have minimal cartridge identification features. For example, U.S. Pat. No. 5,636,032 for System and Method for Informing a User of a Marking Material Status in a Printing Environment issued to Springett includes a program which counts the number of pixels receiving ink and, based on typical coverage rates, estimates the ink needed, counts the ink used and estimates a replacement date. The only display shows the date when the cartridge needs to be replaced. Although the cartridge being used is not specifically identified, the printer does recognize when an ink correct cartridge is in place and prompts the user afer that fact. U.S. Pat. No. 4,872,027 for Printer Having Identifiable Interchangeable Heads issued to Buskird et al. describes a cartridge head including an identification code which a computer controller registers in order to select the appropriate inputs associated with the control of a particular head configuration.

I found that none of the above references teach or suggest a printer that prompts a user to enter cartridge identification information which the printer stores and associates ink status information therewith.

SUMMARY OF THE INVENTION

A first object of the present invention is to provide an improved process and apparatus for associating cartridge status data with a cartridge.

A second object is to provide an apparatus and process for accurately detecting the state of an ink cartridge mounted on a printer.

The present invention contemplates assigning a specific identification (ID) to an ink cartridge by entry of same in response to a printer prompt. A printer is equipped with memory that stores the ID. The invention further includes associating cartridge status information pertaining to the identified cartridge and displaying same.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components wherein.

DETAILED DESCRIPTION OF THE PREFERRED EMBODIMENT

Figure 1:
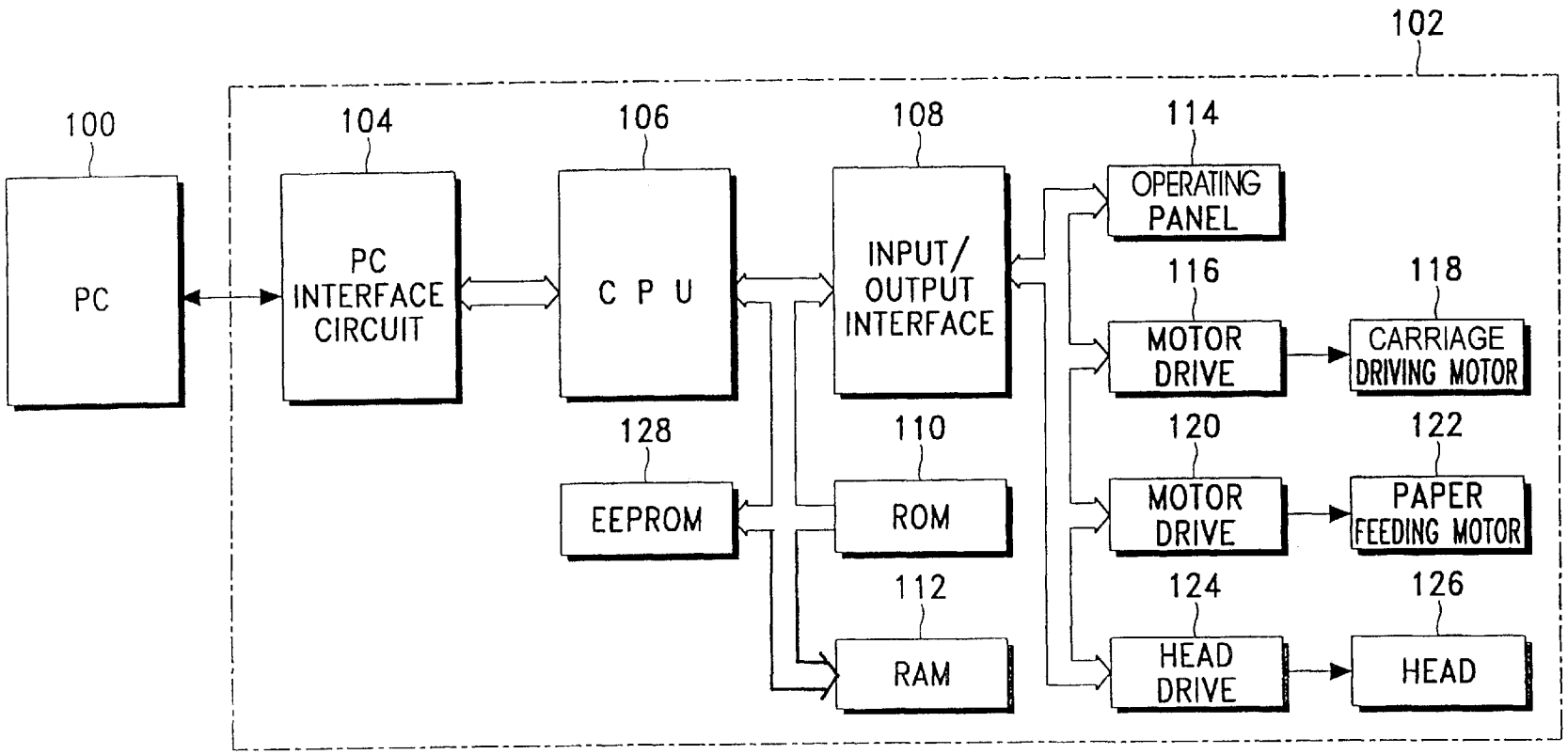
FIG. 1 is a block diagram of one embodiment for the practice of the present inventive apparatus.

Referring to FIG. 1, a system constructed for the practice of the present invention may use an electrically erasable and programmable read only memory (EEPROM) 128 in addition to the constituent elements of the conventional system of the printer 102. The personal computer (PC) 100 and the printer 102 are connected with each other by means of the conventional parallel interface. The PC interface circuit 104 interfaces signals transferred between the PC 100 and the printer 102.

The central processing unit (CPU) 106 executes programs stored in the ROM 110 and controls various component parts of the printer 102 via input/output interface 108. The ROM 110 stores the executive program and various initial data of the CPU 106. The RAM 112 temporarily stores data produced during operations of the CPU 106. The input/output interface 108 interfaces signals received and transferred between the CPU 106 and the I/O devices, i.e., the operating panel 114, the motor drives 116, 120, and the head drive 124. The operating panel 114 has a plurality of keys to enter various instructions into the CPU 106, and a display for presenting various states by the CPU 106. The motor drive 116 drives the carriage driving motor 118 under the control of the CPU 106. The carriage driving motor 118 is driven by the motor drive 116 to move the ink cartridge (not shown in drawings). The motor drive 120 drives the paper feeding motor 122 under the control of the CPU 106. The paper feeding motor 122 is driven by the motor drive 120 to feed recording medium such as papers into the print machine. The head drive 124 drives the head 126 to eject ink through the nozzle provided on the head 126, thereby printing image data on the recording medium. The EEPROM 128 stores the cartridge state or status data. This data typically is not correlated to a specific ink cartridge. Any time the cartridge is replaced, the EEPROM remains unchanged. Thus, the printer will associate status information with the replacement cartridge that is appropriate to the replaced cartridge. Accordingly, the replacement cartridge likely will not be used as would be appropriate for the replacement.

The present invention overcomes this status information misassociation by providing printers with the ability to recognize specific ink cartridges and properly associate each with its particular status data.

Figure 2:
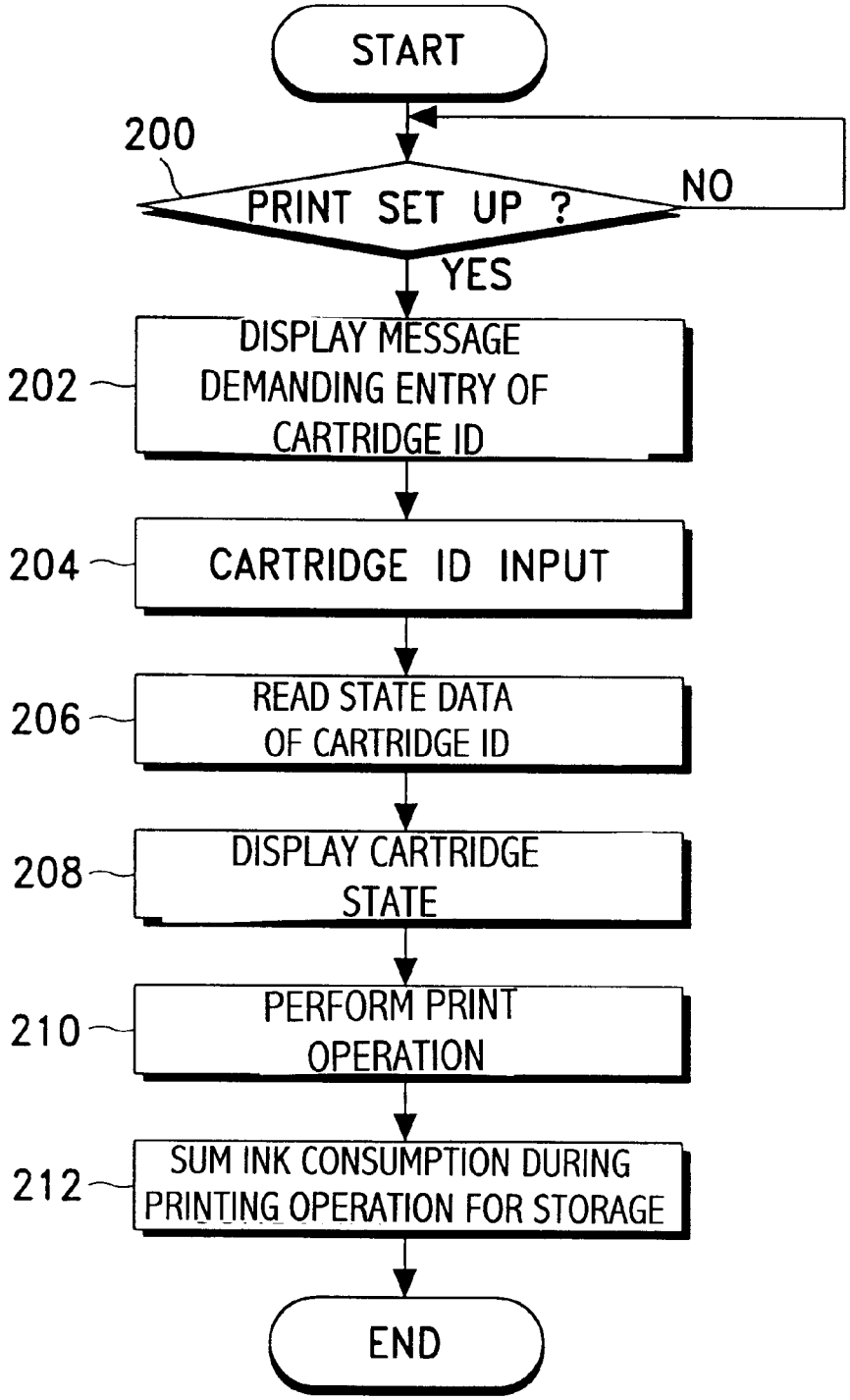
FIG. 2 is a flow chart illustrating one process for the practice of the present invention.

In order to accurately detect the state of an ink cartridge according to a cartridge ID, the invention provides software prepared in accordance with the process as illustrated by the flow chart, as depicted in FIG. 2, which is to be incorporated into conventional printer drivers of the PC 100.

Referring to FIG. 2, the CPU 106 reads the state data corresponding to the cartridge ID entered by user when setting up the printer from the EEPROM 128. The state of the ink cartridge is displayed on the monitor screen, including ink consumption data corresponding to the cartridge ID. The data also are delivered to the EEPROM 128 to register anticipated additional consumption.

When printing, the user switches the printer 102 to standby mode and selects the printing documents and the printer driver recognized by the PC 100. After setting up the printer, the printer driver responds in step 200 to the printer setup, and displays in step 202 the message demanding the entry of the cartridge ID corresponding to the ink cartridge mounted on the printer. When the user enters the cartridge ID in step 204, the printer driver reads the state data corresponding to the cartridge ID from EEPROM 128, in step 206, and displays the corresponding cartridge state on the monitor, in step 208. Then, in step 210, the printer driver prints out the selected documents, and sums the ink consumption during the print operation with overall consumption data and stores it, as the state data of the ink cartridge corresponding to the cartridge ID, in the EEPROM 128, in step 212. Thereafter, when entering the cartridge ID, the state of the corresponding ink cartridge is presented through the steps 204–208 on the basis of the updated state data stored lately.

As described above, since the ink consumption of the ink cartridge can be detected by a simple software manipulation according to the present invention, the user is accurately informed of the state of an ink cartridge mounted on the printer, and accordingly the present invention has the advantage that the ink cartridges should be properly used through the end of their lifetime and replaced only at appropriate times.

What is claimed is:

1. A method for monitoring a status of an ink cartridge, comprising the steps of:

providing the printer with a memory;

prompting a user to identify the ink cartridge with identification data corresponding to the ink cartridge;

providing the printer with a controller which is electrically connected to the memory, and which is responsive to the identification data;

retrieving, by means of the controller and from the memory, status data associated with the identification data;

providing the printer with a display which is electrically connected to the controller;

displaying the status data on the display by means of the controller;

ejecting ink from the ink cartridge in response to a print command; and providing the printer with a sensor which is electrically connected to the controller, and which is responsive to an amount of ink ejected from the ink cartridge for generating an ink signal;

wherein the controller is responsive to the ink signal;

said method further comprising the steps of:

generating ink data corresponding to the ink signal with the controller;

summing the ink data with the status data and generating updated status data with the controller; and storing the updated status data as status data in the memory with the controller, to provide ink status information specifically representative of the status of the ink cartridge currently in use rather than ink status information representative of an ink cartridge previously in use.

2. The method of claim 1, said step of displaying the status data on the display by means of the controller further comprising the step of displaying the identification data.

3. The method of claim 1, wherein the memory comprises an EEPROM.

4. A method for monitoring ink cartridge status, comprising the steps of:

providing a printer with identification data corresponding to the ink cartridge;

providing the printer with memory;

providing the printer with a controller which is electrically connected to the memory, and which is responsive to the identification data;

retrieving, by means of the controller and from the memory, status data associated with the identification data;

providing the printer with a display electrically connected to the controller;

displaying the status data on the display by means of the controller;

ejecting ink from the ink cartridge in response to a print command; and providing the printer with a sensor which is electrically connected to the controller, and which is responsive to an amount of ink ejected from the ink cartridge for generating an ink signal;

wherein the controller is responsive to the ink signal;

said method further comprising the steps of:

generating ink data corresponding to the ink signal with the controller;

summing the ink data with the status data and generating updated status data with the controller; and storing the updated status data as status data in the memory with the controller to provide ink status information specifically representative of the status of the ink cartridge currently in use rather than ink status information representative of an ink cartridge previously in use.

5. The method of claim 4, said step of providing a printer with identification data further comprising the steps of:

demanding user entry of an identification value corresponding to the ink cartridge; and converting the identification value into identification data with the controller.

6. The method of claim 4, said step of displaying the status data on the display by means of the controller further comprising the step of displaying the identification data.

7. The method of claim 4, wherein the memory comprises an EEPROM.

8. An apparatus for monitoring ink cartridge status in a printer, comprising:

a memory installed in the printer, said memory being provided with a record of status data uniquely associated with a record of identification data, each said status data corresponding to an amount of ink ejected from an ink cartridge associated with said identification data;

a controller electrically connected to said memory;

a variable visual display electrically operationally driven by said controller to generate a visual display demanding entry of an identification value associated with an ink cartridge; and generating means responsive to an amount of ink ejected from an ink cartridge for generating an ink signal corresponding to said amount of ink ejected;

said controller being responsive to said entry of said identification value associated with said ink cartridge for generating identification data corresponding to said identification value, and said controller driving said display to generate a visual display of said status data associated with said identification data; and said controller being connected to said generating means and responsive to said ink signal for generating ink data corresponding to said ink signal, for summing said ink data with said status data, for generating updated status data, and for storing said updated status data as status data in said memory, all being associated with said identification data, thereby providing ink to provide ink status information specifically representative of the status of the ink cartridge currently in use rather than ink status information representative of an ink cartridge previously in use.

9. The apparatus of claim 8, wherein said memory comprises an EEPROM.

10. The apparatus of claim 8, wherein said variable visual display is separate from said printer and is connected to a host computer connected to said printer.

11. An apparatus for monitoring a status of an ink cartridge in a printer, comprising:

a memory installed in the printer, said memory storing a record of status data uniquely associated with a record of identification data, each said status data corresponding to an amount of ink ejected from an ink cartridge associated with said identification data;

a controller electrically connected to read from said memory and to write said status data into said memory;

a display operationally driven by said controller to generate varying visual displays; and generating means responsive to an amount of ink ejected from said ink cartridge for generating an ink signal corresponding to said amount of ink ejected;

said controller reading said identification data from said memory and being responsive to said ink signal for generating ink ejection data corresponding to said ink signal, for summing said ink ejection data with said status data, for generating updated status data, and for storing said updated status data as status data in said memory in association with said identification data, thereby to provide ink status information specifically representative of the status of the ink cartridge currently in use rather than ink status information representative of an ink cartridge previously in use.

12. The apparatus of claim 11, wherein said controller drives said display to generate a visual message demanding entry of an identification value associated with said ink cartridge; and wherein said controller is responsive to said entry of said identification value associated with the ink cartridge for generating identification data corresponding to said identification value, and said controller drives said display to generate a message representative of said status data associated with said identification data.

13. The apparatus of claim 11, wherein said memory comprises an EEPROM.

14. The apparatus of claim 11, wherein said display is separate from said printer and is connected to a host computer which is connected to said printer.

* * * * *